US007047776B2

(12) United States Patent
Blake

(10) Patent No.: US 7,047,776 B2
(45) Date of Patent: May 23, 2006

(54) ATTACHMENT DEVICE

(75) Inventor: Graeme Ashley Blake, Hamilton (NZ)

(73) Assignee: Keysnaps IP Limited, Hamilton (NZ)

( * ) Notice: Subject to any disclaimer, the term of this patent is extended or adjusted under 35 U.S.C. 154(b) by 0 days.

(21) Appl. No.: 10/221,648

(22) PCT Filed: Mar. 9, 2001

(86) PCT No.: PCT/NZ01/00038

§ 371 (c)(1),
(2), (4) Date: Sep. 16, 2002

(87) PCT Pub. No.: WO01/69020

PCT Pub. Date: Sep. 20, 2001

(65) Prior Publication Data

US 2003/0037580 A1 Feb. 27, 2003

(30) Foreign Application Priority Data

Mar. 14, 2000 (NZ) ..... 503361

(51) Int. Cl.
*E05B 19/04* (2006.01)

(52) U.S. Cl. ..... 70/408; 70/456 R; 70/459

(58) Field of Classification Search ..... 70/408, 70/456 R, 456 B, 457–460; 24/3.6; 40/330, 40/634; 206/38.1, 37.1–37.8
See application file for complete search history.

(56) References Cited

U.S. PATENT DOCUMENTS

| | | | | | |
|---|---|---|---|---|---|
| 2,482,422 | A | * | 9/1949 | Loew | |
| 2,672,044 | A | | 3/1954 | Martin | 70/456 R |
| 2,685,193 | A | | 8/1954 | Marymont | |
| 2,790,319 | A | * | 4/1957 | Brunner | 70/456 R |
| 3,863,477 | A | * | 2/1975 | Klein | 70/456 R |
| 4,297,864 | A | | 11/1981 | Beier | 70/456 B |
| 4,959,983 | A | * | 10/1990 | Hsu | 70/456 R |
| 5,038,590 | A | * | 8/1991 | Sawyer et al. | 70/458 |
| 5,083,662 | A | * | 1/1992 | Bishop et al. | 206/37.1 |
| 5,433,096 | A | * | 7/1995 | Janssen et al. | 70/278.3 |
| 5,689,985 | A | * | 11/1997 | Chamberlain | 70/438 |
| 5,775,148 | A | | 7/1998 | Layton et al. | 70/408 |
| 6,050,118 | A | * | 4/2000 | Kito | 70/456 R |
| 6,308,542 | B1 | * | 10/2001 | Bolton | 70/408 |

FOREIGN PATENT DOCUMENTS

| | | | | |
|---|---|---|---|---|
| DE | 22 15 332 | | 10/1973 | |
| DE | 27 12 759 | | 9/1978 | |
| FR | 667856 | * | 10/1929 | 70/408 |
| FR | 1447435 | * | 6/1966 | 70/408 |
| FR | 2149008 | * | 3/1973 | 70/408 |
| GB | 411 405 | | 6/1934 | |
| NL | 9 001 456 | | 1/1992 | |

* cited by examiner

OTHER PUBLICATIONS

Kenneth Mason, "Snap on Plastic Key Top", Research Disclosure, Publications, Hampshire, GB No. 329, Sep. 1, 1991 p. 657 XP000226206 ISSN: 0374-4353 the whole document.

*Primary Examiner*—Lloyd A. Gall
(74) *Attorney, Agent, or Firm*—Young & Thompson

(57) ABSTRACT

The present invention relates to an attachment device for keys which includes a key holding body by which the head and shaft of a key can be secured and a joining mechanism configured to join with the joining mechanism on like attachment devices. The present invention can be configured into a variety of shapes and receive print thus providing the opportunity for the attachment device to act as a promotional vehicle.

15 Claims, 3 Drawing Sheets

ATTACHMENT DEVICE

TECHNICAL FIELD

The invention relates to an improved attachment.

More particularly the present invention relates to improvements in organising articles such as keys in an orderly fashion.

BACKGROUND ART

Many objects such as keys, Allen keys, and so forth are kept together on one device. In the case of keys, key rings are usually employed to keep keys in a bundle. Unfortunately these devices can easily become tangled. Further, it can be difficult to locate a particular key in a bunch of keys quickly due to the similarity in types and colours.

Another problem with traditional key rings is that they often have a split ring configuration. This configuration is difficult to add new keys to, or remove from, which can be frustrating for the owner of the keys.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided an attachment device for keys of the type having a key head rigidly and coplanarly connected to a key shaft, comprising: a key holding body adapted to receive and hold the head of a key so that the head of the key is substantially covered by the key holding body and the key shaft protrudes from the key holding body, a joining means adapted to allow interconnection of two or more key holding bodies, wherein the joining means is provided on the key holding body distal from the key shaft and the key head and comprises a complementary lug and recess arrangement such that at least two key holding bodies can be pivotally and reversibly joined together by a push fit arrangement of the lug from the first key holding body being push fit into the recess of a second key holding body, so that in use the second key holding body can be pivoted at least 90 degrees away from the direction of the first key shaft extending from the first key holding body to allow that portion of the first key holding body surrounding the first key head to be gripped to allow the key to be turned.

The key holding body may come in a number of forms, but its main function is to ensure there is a means by which the key head and shaft can be held.

An embodiment of the present invention whereby the attachment device is OEM (Original Equipment Manufacturing), the key holding body may be in the form of a key head integrally moulded around a key shaft.

However in other embodiments of the present invention the key holding body may be able to receive and hold the existing head of a key.

For example, the key holding body may include two halves hingedly attached with an aperture in the hinged area through which the shaft of the key can pass when the key holding body is in an open position. The key holding body could then be closed to then hold the head of the key and providing a means by which the shaft of the key can be secured and readily used.

Other embodiments of key holding bodies may include two separate halves which can be clamped over the top of an existing key head. There may be other embodiments which may achieve the same function through different means.

In one embodiment the key holding body may comprise a receiving portion and a lid and the receiving portion may attach to the lid by snap fit arrangement, although other configurations such as a bayonet clip, screw and thread combination, magnet and so forth can be used.

The joining means may come in a number of forms, but in preferred embodiments the joining means is in the form of a complementary lug and recess arrangement as described above which enables the attachment devices to be easily pushed and joined together or readily pulled apart.

The joining means may also be in the form of a releasable adhesive or perhaps even a hook and pile fastening such as Velcro™.

While the attachment device can be made of any suitable material, in preferred embodiments it is made of a plastics material which is capable of slight deformations which can aid in the holding together of the key holding body and the attachment and release of the joining means.

Plastics material also allows the attachment devices to be colour coded making for ready selection of the appropriate key.

The applicant has recognised that it is preferable that keys joined together can move in relation to each other to enable one key to be readily selected from the others. Thus, in the preferred embodiment of the present invention the joining means is substantially circular, thus allowing the attachment devices joined together to rotate with respect to each other around the joining means—thus enabling one key to be easily swung out of the bunch.

It is possible that certain designs of the present invention may require additional assistance in securing the head of the key in relation to the key holding body. Thus, there may be within the key holding body packing material, foam, adhesive or the like which can prevent the key head and/or shaft moving relative to the key holding body.

The attachment device may come in a number of shapes, although it is envisaged that a portion of the attachment device closest to the key shaft is a similar size and shape (may be slightly larger) than a key head.

If the present invention is OEM manufactured, the user of the key will still need a gripping portion to operate the key shaft. If the present invention is to be used to enclose existing key heads, then this needs to be accommodated within the attachment device.

In some embodiments of the present invention the attachment device may be custom made. This means that the shape of the device may vary accordingly to the customer for whom it is intended or the organisation providing the attachment device. Thus, the present invention can be used as a promotional vehicle.

As an example of how the present invention can be used as a promotional vehicle, the attachment device could take the form of a character, cartoon outlines, vehicle outlines and so forth.

Each attachment device may take on separate characteristics which have a common theme so that when attachment devices are placed together that theme is realised. For example, attachment devices may each be a different component of a hamburger which when they are together makes a full hamburger.

It is preferable that the material from which the attachment device is made can receive print, which again affords the opportunity to use the present invention as a promotional vehicle.

As it can be seen, there is provided a ready means by which keys can be joined directly together in a tidy arrangement which stills allows keys to be selected.

Some embodiments may have an aperture through the attachment device so that a string, chain or some other length of material (even a split ring) can be placed there through.

In some embodiments there may be provided a mounting rack into which the attachment device can be placed to allow a ready storage if the keys are not in use.

There may be provided an adapter on the attachment device, just in case there is a key which may not fit within the attachment device but can still be attached to the main bunch of keys associated with attachment devices.

It should be appreciated that the present invention has a number of advantages over the prior art.

Firstly, there is provided a ready way by which keys can be attached to each other without the problems associated with having keys on devices such as split rings.

However, the main advantage is that in use, because the joining means and pivot point is located at a distant position from the key head it allows for much easier operation of an individual key within a key set as an individual key can easily be selected and pivoted out of the set, and there is a large surface area which provides a comfortable and ergonomically sound grip for holding and turning the key.

Another advantage is that the keys are readily accessible and will not become tangled as in the case of prior art key rings.

Also, the keys can be readily selected as they are connected together in an ordered way and may be colour coded.

In embodiments that are not OEM manufactured, the present invention can be used with keys of a variety of shapes and sizes and will thus confer some consistency to the traditional bunch of keys.

The present invention also provides a ready way by which promotional material can be displayed.

BRIEF DESCRIPTION OF DRAWINGS

Further aspects of the present invention will become apparent from the following description which is given by way of example only and with reference to the accompanying drawings in which.

| | |
|---|---|
| FIG. 1 | shows a side view of a preferred embodiment of the present invention; wherein.

BEST MODES FOR CARRYING OUT THE INVENTION

Figure 1:
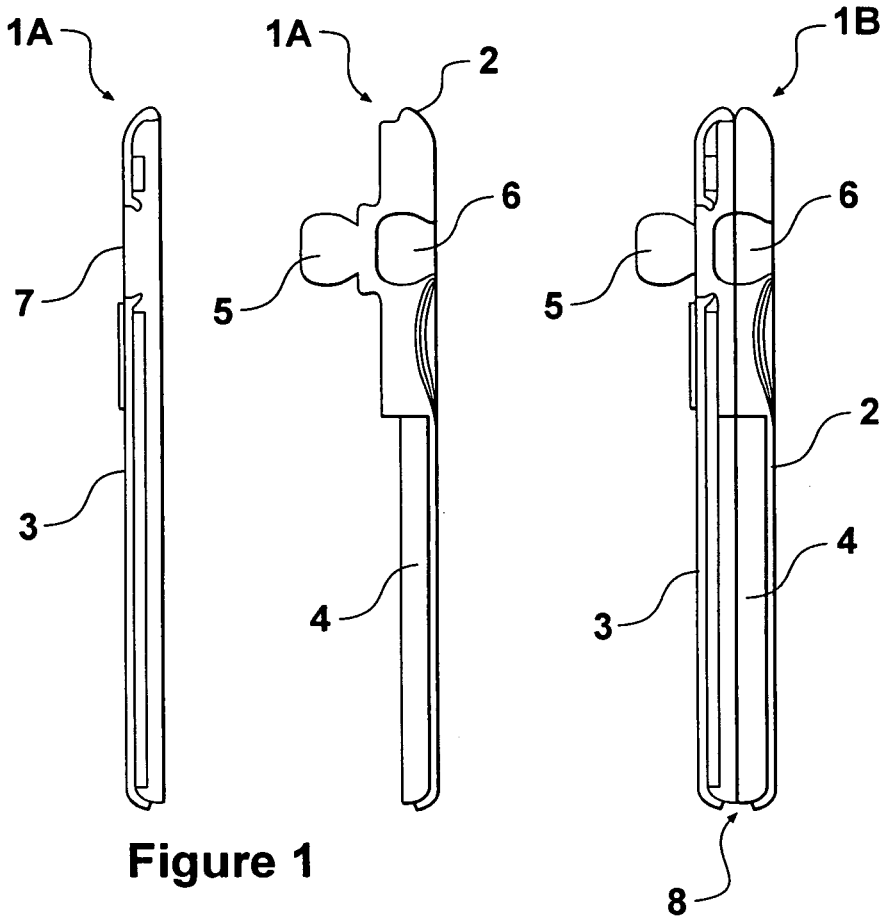
FIG. 1A shows a side view of both the receiving portion and the lid of a key holding body and FIG. 1B shows the portions of the key holding body joined together; |
| FIG. 2 | shows a plan view of a key holding body according to a preferred embodiment of the present invention; and |
| FIG. 3 | shows an adapter according to one aspect of the present invention; and |
| FIG. 4 | shows a mounting rack according to one aspect of the present invention; and |
| FIG. 5 | Illustrates the receiving portion of a key holding body receiving a key head according to a preferred embodiment of the present invention, and |
| FIG. 6 | shows an illustration of a preferred embodiment of the present invention attached to other preferred embodiments of the present invention as a set of keys, and |
| FIGS. 7 and 7A | show illustrations of a less preferred embodiment of the present invention integrally formed with a key, and |
| FIGS. 8A, 8B and 8C | show embodiments of the present invention comprising an aperture through the joining means of the key holding bodies, and |
| FIG. 9 | shows a perspective view of a preferred embodiment of the present invention as shown in FIGS. 1 and 2. |
| FIG. 10 | shows an embodiment of the present invention where the attachment device has a special shape and design. |

With reference to FIG. 1 there is shown a side view of a preferred embodiment of the present invention, wherein the key holding body comprises a receiving portion 2 and a lid 3.

The receiving portion 2 fits to the lid 3.

The receiving portion 2 has a receiving recess 4 adapted to receive for example a key head.

Other objects may be received by the receiving portion 2, depending on its configuration within the scope of the present invention.

A male member 5 of a snap lock couple is formed on one side of the receiving portion 2, and will protrude through the hole 7 of the lid once the lid 3 is snapped into place.

A female recess 6 of the snap lock couple is formed on the opposite side of the receiving portion 2 to the male member 5.

The female recess 6 is adapted to receive the male member 5 of a like device.

An aperture 8 is provided at the end of the assembled apparatus as shown in FIG. 1B, for the coded portion of the key or the key shaft to protrude therefrom.

The present invention is designed so that a number of like devices can be removeably attached together using the mating couple, to allow a plurality of keys to be stored conveniently.

Figure 2:
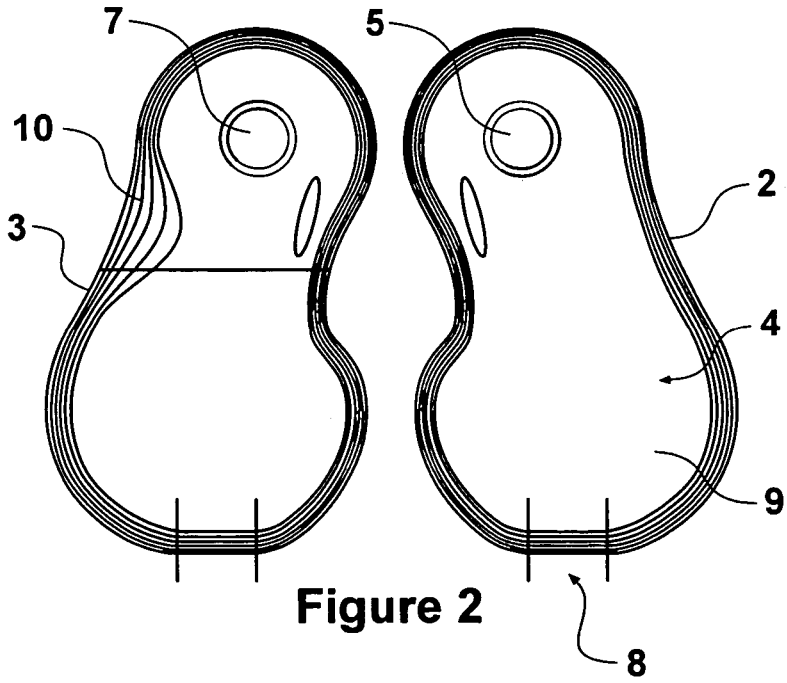

With reference to FIG. 2 there is shown a plan view of the receiving portion 2 and the lid 3 of a key holding body.

The receiving recess 4 may include at 9, an attachment means such as a die cast adhesive foam, to assist in securing the key head in the receiving portion.

A thumb gap 10 is provided to permit easy access to the particular device containing the desired key, and also to aid in the separation of the receiving portion 2 and the lid 3.

Figure 3:
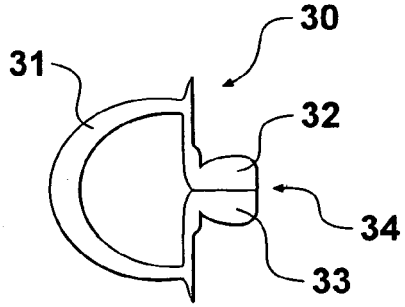

With reference to FIG. 3, there is shown a further aspect of the present invention in the form of an adapter. The adapter is designed to allow attachment of keys that do not fit into the receiving portion of the key holding body.

The adapter 30 is effectively a loop 31 that includes ends 32 and 33 that collectively perform the equivalent of the male member 5 in FIG. 1 and FIG. 2. The ends 32 and 33 may be separated, to allow fitment through a hole in the key head. The key head is then secured and may move about the loop 31. The male member 34 may then be attached to a device as shown in FIG. 1 or 2, or 4.

Figure 4:
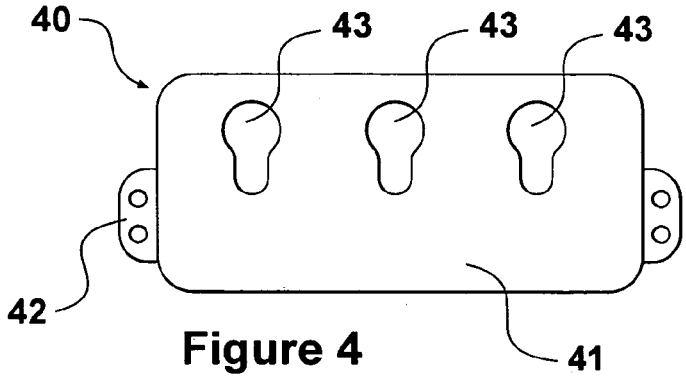

With reference to FIG. 4, there is shown a mounting rack 40 configured to allow convenient storage of the devices shown in FIGS. 1, 2 and 3.

The mounting rack 40 includes a face 41 with brackets 42 for the fitment to a wall or the like.

Openings 43 are provided that are adapted to receive the male member 5, or 34, of the devices shown in FIGS. 1, 2 and 3. The male member 5 or 34 may fit into the wider part of the openings 43 and then slot into the narrow part securing the devices in place.

Figure 5:
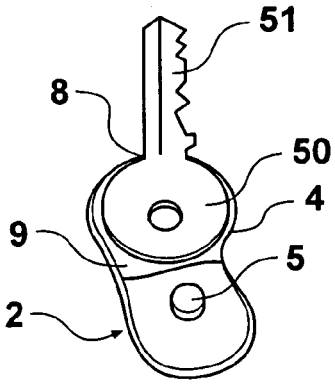

With reference to FIG. 5, there is shown a receiving portion 2 as depicted in FIGS. 1 and 2, which has in the receiving recess 4 a key head 50 with the coded portion or shaft 51 of the key 50 protruding through the aperture 8.

Figure 6:
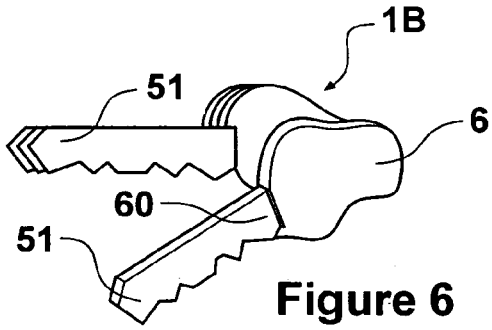

With reference to FIG. 6, there is shown a plurality of preferred embodiments according to those shown in FIGS. 1, 2 and 5 that have been coupled together using the snap lock couples, with the coded section or shafts 51 of the keys protruding therefrom. The key 60 that has been swivelled downwards illustrates how the present invention may be used to easily store and access a bunch of keys. The key 60 is singled out from the rest of the bunch of keys, and can then be used conveniently and easily.

A further like device could be attached to the female recess 6, increasing the size of the bunch of keys 51.

Figure 7A:
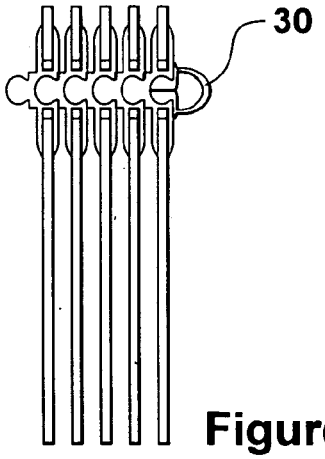
Figure 7:
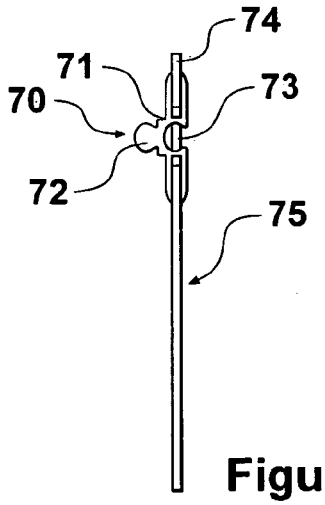

With reference to FIG. 7, there is shown a side view of a further aspect of the present invention shown by general arrow 70.

The receiver 71, which includes male member 72 and female recess 73 formed therein, is integrally formed around the head 74 of the key 75. The female recess 73 is located in this embodiment, through the centre of the key 75.

In this fashion, keys may be manufactured with the present invention pre-moulded around them enabling like keys to be fitted together in a bunch according to the present invention, with the aforementioned advantages.

This is an alternative embodiment of the present invention whereby a consumer does not need to purchase an after market product to enjoy the benefits of the present invention, as the present invention was already pre-moulded about the object, a key head in this example.

FIG. 7A shows a plurality of keys shown in FIG. 7 joined together in a bunch in accordance with the present invention. The adapter 30 shown in FIG. 3 is shown attached to the right most key of the bunch.

With reference to FIG. 8 there is shown further embodiments of the present invention, whereby a second aperture is formed through the joining means.

This will allow multiple devices according to the present invention to be secured with a conventional key ring or chain.

Figure 8A:
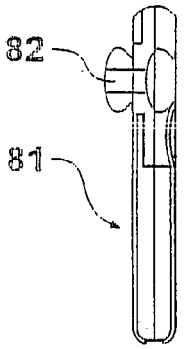

FIG. 8A shows a representation 81 of the embodiment represented in FIG. 1 previous, but with the addition of the second aperture 82 through the joining means.

Figure 8B:
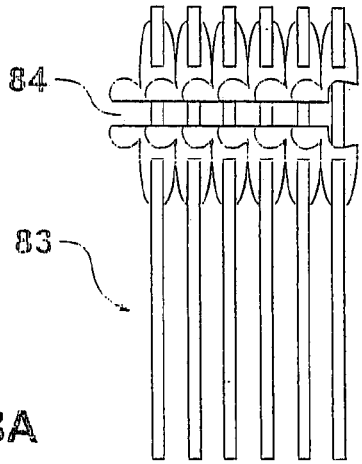
Figure 8C:
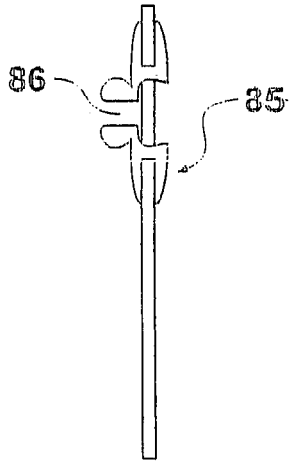

FIG. 8B shows a representation 83 of the embodiment in FIG. 7A previous which is a plurality 83 of the embodiment 85 in 8C connected together forming a continuous second aperture 84 through the adjacent joining means. FIG. 8C shows a single element as previously represented in FIG. 7, but having the second aperture 86 formed through the joining means.

The second apertures may be used to place a key chain, string, rope or some other securing length there through to secure the bunch.

Figure 9:
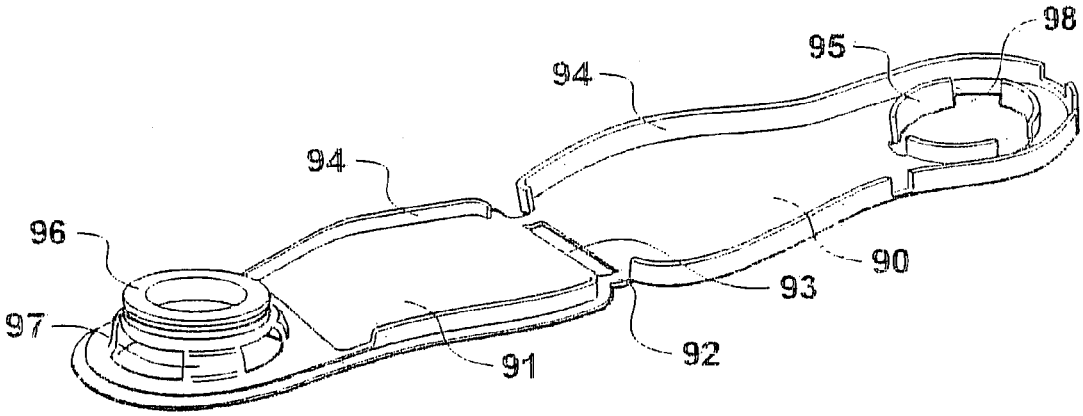

With reference to FIG. 9 there is shown a further embodiment of the present invention. The embodiment shown in FIG. 9 is largely the same as that shown in FIG. 1.

The embodiment of FIG. 9 shows two identical halves 90 and 91 forming a lid and a receiving portion. The halves 90 and 91 are joined by a hinge 92 which forms a gap 93 there between. When the halves 91 and 92 are folded and closed against one another, the gap 93 is adapted to fit the coded portion or shaft of a key there through. The receiving portions 94 of the halves 90 and 91 are adapted to receive the head of the key.

A joining means having a female part 95 adapted to receive a male part 96 are on either half 90 and 91. They are configured so the male part will mate with the female part of a like device.

A snap lock arrangement shown by protrusions 97 that fit and snap lock into recesses 98 may be provided to retain the receiving portion and lid against one another.

In some embodiments however the point where the male part 95 and female part 96 join may be a simple aperture instead.

Figure 10:
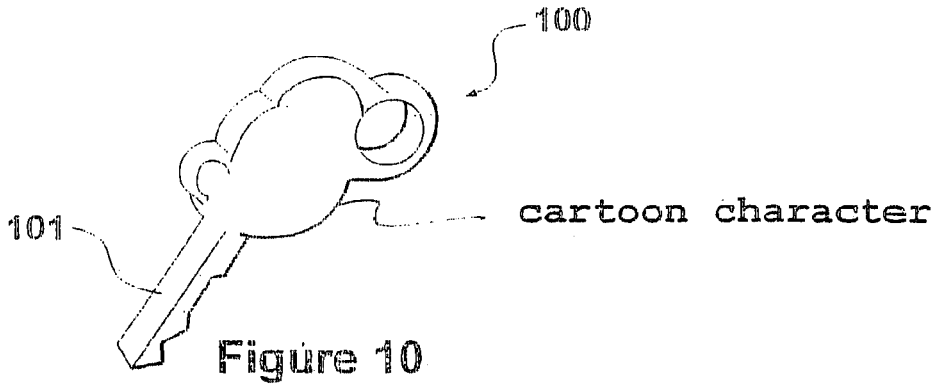

With reference to FIG. 10, there is shown a further embodiment or possible use of the present invention.

The outline of the present invention may be configured so that it is in the shape of a cartoon character. The embodiment of FIG. 10 shows the invention 100 closed up with a key inside and a key shaft 101 protruding therefrom.

The outline of the present invention could be configured to conform to other shapes as desired.

Aspects of the present invention have been described by way of example only and it should be appreciated that modifications and additions may be made thereto without departing from the scope of the appended claims.

The invention claimed is:

1. An attachment device for keys having a key head rigidly and coplanarly connected to a key shaft, comprising:

a key holding body adapted to receive and hold the head of a key so that the head of the key is substantially covered by the key holding body and the key shaft protrudes from the key holding body; and a joining means adapted to allow interconnection of two or more key holding bodies, wherein the joining means is provided on the key holding body distal from both the key shaft and the key head when in use and comprises a complementary lug and recess arrangement such that at least two key holding bodies can be pivotally and reversibly joined together by a push fit arrangement of the lug from a first key holding body being push fit into the recess of a second key holding body, so that in use the second key holding body can be pivoted at least 90 degrees away from the direction of the first key shaft extending from the first key holding body to allow that portion of the first key holding body surrounding the first key head to be gripped to allow the key to be turned.

2. The attachment device as claimed in claim 1, wherein the key holding body comprises a receiving portion and a lid.

3. The attachment device as claimed in claim 2, wherein the receiving portion attaches to the lid by snap fit arrangement.

4. The attachment device as claimed in claim 2, wherein, the receiving portion and the lid are separate and can be clamped over the top of the key head, and a portion of the attachment device is integral with the receiving portion and another portion of the attachment device is integral with the lid.

5. The attachment device as claimed in claim 2, wherein the receiving portion and the lid are hingedly attached.

6. The attachment device as claimed in claim 1 wherein the key holding body is shaped in order to enable the attachment device to act as a promotional vehicle.

7. The attachment device as claimed in claim 1 wherein the key holding body is shaped as a cartoon character.

8. The attachment device as claimed in claim 1, wherein the key holding body includes a surface for receiving print.

9. The attachment device as claimed in claim 5, wherein the key holding body comprises an aperture within or adjacent to the hinged area, through which aperture the shaft of the key can pass so as to protrude from the key holding body.

10. The attachment device as claimed in claim 1, wherein the joining means is formed integrally with the key holding body as single pieces of the same material.

11. The attachment device as claimed in claim 2, wherein the joining means comprises a male member integrally formed on one of the receiving portion and lid, and a mating female member integrally formed on the other of the receiving portion and lid.

12. The attachment device as claimed in claim 1, wherein at least one of the internal surfaces of the key holding body comprises an adhesive.

13. The attachment device as claimed in claim 1, wherein the attachment device further includes an adapter designed to allow the attachment device to be attached to objects not equipped with complementary joining means.

14. The attachment device as claimed in claim 1, further including a mounting rack for storing the keys and associated attachment devices.

15. A combination of a key and an attachment device, comprising:

a key with a head and a shaft, the head being rigidly and coplanarly attached to the shaft; and an attachment device comprising a key holding body adapted to receive and hold the head of a key so that the head of the key is substantially covered by the key holding body and the key shaft protrudes from the key holding body, a joining means adapted to allow interconnection of two or more key holding bodies, wherein, the joining means is provided on the key holding body distal from both the key shaft and the key head when in use and comprises a complementary lug and recess arrangement such that at least two key holding bodies can be pivotally and reversibly joined together by a push fit arrangement of the lug from a first key holding body being push fit into the recess of a second key holding body, so that in use the second key holding body can be pivoted at least 90 degrees away from the direction of the first key shaft extending from the first key holding body to allow that portion of the first key holding body surrounding the first key head to be gripped to allow the key to be turned, and the key head is secured within the key holding body.

* * * * *